United States Patent [19]

Reynolds

[11] Patent Number: 4,802,513

[45] Date of Patent: Feb. 7, 1989

[54] CLOSED SYSTEM CHEMICAL CONTAINER

[75] Inventor: Richard P. Reynolds, Greensboro, N.C.

[73] Assignee: Ciba-Geigy Corporation, Ardsley, N.Y.

[21] Appl. No.: 364,322

[22] Filed: Apr. 6, 1982

Related U.S. Application Data

[63] Continuation-in-part of Ser. No. 261,431, May 7, 1981, abandoned.

[51] Int. Cl.[4] ..... B65D 83/00

[52] U.S. Cl. ..... 141/311 R; 222/400.7; 137/312; 141/302; 251/149.8

[58] Field of Search ..... 137/614.02–614.05, 137/837, 854, 312; 251/149.6, 149.8; 222/148, 400.7, 400.8; 141/1, 2, 18, 89–91, 289, 301, 311 R, 346, 347–350, 291–293, 302

[56] References Cited

U.S. PATENT DOCUMENTS

| | | | |
|---|---|---|---|
| 2,936,779 | 5/1960 | Kindred | 137/854 |
| 3,166,106 | 1/1965 | Reeve | 141/91 |
| 3,941,149 | 3/1976 | Mittleman | 137/854 |
| 4,077,429 | 3/1978 | Kimball | 141/302 |
| 4,084,606 | 4/1978 | Mittleman | 137/854 |
| 4,108,336 | 8/1978 | Anderson | 222/148 |
| 4,119,114 | 10/1978 | Bolton et al. | 137/318 |
| 4,142,658 | 3/1979 | Golding | 222/400.7 |
| 4,150,771 | 4/1979 | Golding | 222/400.7 |
| 4,218,407 | 8/1980 | Robertson | 137/854 |
| 4,245,760 | 1/1981 | Stevenson et al. | 222/148 |

FOREIGN PATENT DOCUMENTS

| | | |
|---|---|---|
| 10863/70 | 8/1971 | Australia . |
| 2146267 | 9/1971 | Fed. Rep. of Germany . |

OTHER PUBLICATIONS

"Agri-Chemical Age" Sep./Oct. 1978, p. 17.

*Primary Examiner*—Henry J. Recla
*Assistant Examiner*—Ernest G. Cusick
*Attorney, Agent, or Firm*—Karl F. Jorda; Edward McC. Roberts

[57] ABSTRACT

A closed system for emptying liquid chemical containers comprising a first, container-mating device adapted to have a variable length probe coupled to its lower end; the first device having a two-way valve for filling and emptying the container, and providing a separate path for flushing the container; a second, extracting device, adapted to mate with the first device and to be utilized for actuating the valve so as to permit withdrawal of liquid from the container, and for enabling the intake of flushing liquid.

10 Claims, 5 Drawing Sheets

CLOSED SYSTEM CHEMICAL CONTAINER

The present application is a continuation-in-part of application Ser. No. 261,431, now abandoned filed May 7, 1981, the latter having been completely incorporated herein. The benefit of the filing date of application Ser. No. 261,431 is herewith claimed with respect to all common subject matter.

BACKGROUND OF INVENTION

1. Field of the Invention

This invention pertains to liquid chemical containers and, more particularly, to a closed system for emptying from such containers harmful chemicals such as acids, carcinogens and pesticides.

2. Background Information

A significant need has developed to provide means to empty liquid chemical containers so that the risk of human contact is absolutely minimal. This is particularly important in the case of harmful chemicals such as those just noted. The State of California has restricted the open pouring of pesticides for the last four years. That state's legislation and subsequent regulations only control open pouring, and do not address themselves to the possibilities of subsequent contamination through human contact with uncleansed containers or extracting devices. In addition, the Federal EPA is currently in the process of examining the need for restricting open pouring.

In order to provide background for a complete understanding of the present invention, and in order that one may appreciate the precise context of the present invention, reference may be made to the following publication:

"AGRI-CHEMICAL AGE" for September–October 1978, page 19.

That publication describes a "product of the month", which is a closed pesticide transfer system comprising an inexpensive built-in probe, normally installed in the drum by chemical formulators, and a standardized quick coupler. However, in the described system, hand pouring or open pouring from the container is still possible through a two-inch opening for customers not equipped with the complete closed system. In other words, the user has the option of using a special, mating extraction device, or not using it.

Further background material may be obtained from the following U.S. Pat. Nos.: 4,108,336, 4,150,771, and 4,245,760. The first and third of this group of patents relate to chemical container arrangements that may be adapted for use in a closed system. However, the container arrangements in these patents do not completely inhibit open pouring or exposure to the ambient.

U.S. Pat. No. 4,150,771 is the most pertinent of the above cited patents and discloses a closure unit having a two-way valve, adapted to be used with a beer keg. However, such closure unit is not operable, by mating with a unitary extracting device, to permit concurrent flow of chemical contents out of the container and flow of atmosphere into the container at one time; and operable at another time, by reason of the mating with that same extracting device, to permit flow of flushing liquid into the container to spray the interior thereof and withdrawal of said flushing liquid. The closure unit of U.S. Pat. No. 4,150,771 is adapted, by the provision of lugs or the like, to engage with several different coupling devices, to achieve the separate operations described therein.

It is therefore a primary object of the present invention to provide a means for restricting access to a container having harmful chemicals as previously noted such that any ability to "open pour" would be essentially inhibited.

A further object is to restrict dispensing of the liquid to the use of specific mating devices to be described so as to leave both units or devices largely free of contamination following completion of the dispensing operation.

Yet another object is to provide full, automatic, reclosure on completion of dispensation so that whether the container were emptied or not, when the extracting or mating device were disconnected, the container would still meet the original objects.

A still further object is to provide an answer to the previously stated problem of handling dangerous chemicals and restricting access to the container, but using comparatively inexpensive means to attain the desired results.

SUMMARY OF THE INVENTION

In fulfillment of the above-stated objects, a primary feature of the invention resides in a closed system for emptying liquid chemical containers comprising a first or container-mating device adapted to have a variable length probe coupled to its lower end; said first component having a two-way valve for filling and emptying the container, and including means for flushing the container; a second or extracting device, adapted to mate with the first device, for actuating the two-way valve so as to permit withdrawal of liquid from the container, and for enabling intake of flushing liquid in order to cleanse the container.

Another primary feature of the present invention is that the valve system is capable to being opened by the extracting device and of being self-closing, that is, closing as a result of the action of withdrawing the extraction device.

A specific feature of the invention involves a two-way valve system in the container-mating device so that air can be returned to the container to replace the volume of liquid being extracted; also, so that water may be sprayed into the container for cleansing purposes during or subsequent to the extraction of product i.e. The liquid chemical.

Another specific feature resides in the provision that the several units or devices are manufactured from materials known to be physically and chemically compatible with most of the substances or formulations with which the system is useful.

A further specific feature of the invention is that the extractor device is constructed so that exit flow is always totally separated from inlet flow, in other words, a means for isolating the flows is provided.

Yet another feature resides in the construction of the container-mating device such that it is compatible with and can be used in conjunction with the three major types of common closure, that is a 63 mm. screw cap, a Reike flex spout or a two-inch NPT bung.

A principal feature of the present continuation-in-part application resides in an improved probe-closure means which is made to be retractable for the purpose of avoiding a problem encountered in practice and described hereinafter.

Other and further objects, advantages and features of the present invention will be understood by reference to the following specification in conjunction with the annexed drawing, wherein like parts have been given like numbers.

DESCRIPTION OF PREFERRED EMBODIMENTS

In order to meet the criteria for restricting the open pouring of pesticides or the like, it is regarded as essential that the unit contain a two-way valve system. For ease of access, this valve system should also be approachable by an extracting device which only has to register in one plane, the preferred plane being face-to-face, without demanding that the two mating units or devices be individually positioned at any particular point through 360°.

Figure 1:
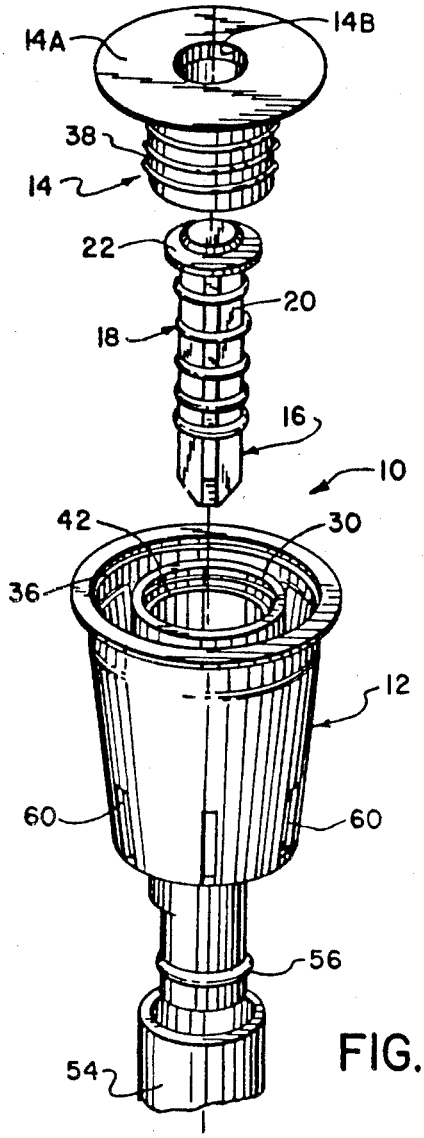
FIG. 1 is an exploded view of a first embodiment of the container-mating closure member or device of the present invention.

Referring now to FIG. 1, there is illustrated a first preferred embodiment of a container-mating closure device in accordance with the present invention. This device 10 comprises four parts: a rigid body 12, a hollow cover 14, having a flange member 14A and a center opening 14B; also, a plunger 16 and a spring 18. The plunger has a shank portion 20, which is surrounded by the spring, and is provided with a cap 22 constituting a valve member. This valve member 22 seats against the lower surface of the inwardly directed portion 14C of the cover. A dynamic seal is thereby formed by the cap 22 under pressure from the spring 18 whose lower end abuts an inwardly directed shoulder 24 at the interior of the body 12. A bore 26 defined by the inner lower cylindrical portion 28 of the body 12 communicates with the interior or bore 29 of the hollow cover 14.

Spaced outwardly from the cylindrical portion 28 is an interior wall 30 of the body 12 which, together with the exterior wall 32, defines a space or passageway 34. The outer portion of flange 14A at the top of the cover 14 forms a seal over the space 34, the flange 14A being normally retained in position at its periphery by a retaining ring 36. Retention of the cover 14 within the body 12 is assured by a series of spaced retainers 38 at the outside of the cylindrical wall 40 of the cover, which retainers cooperate with a like series of spaced retainers at the inside of wall 30.

It will be appreciated that the flange 14A defines a second or flap valve by reason of its sealing of the space 34, being formed from flexible material which also possesses a memory; for example, polypropylene would be a suitable material for these purposes. Thus, as will be explained, the flange 14A is bent downwardly by suitable spaced prongs disposed on a mating device.

Figure 2:
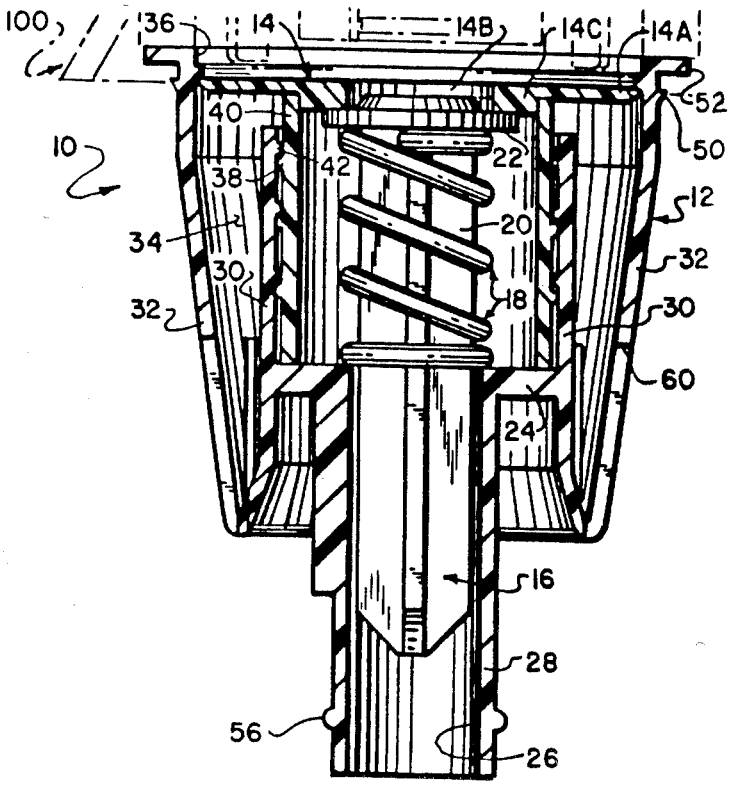
FIG. 2 is a sectional view of the device of FIG. 1, and showing in phantom outline a mating extractor device.

It will be understood that the device or unit seen in FIGS. 1 and 2 can be inserted into all types of containers using various means of attachment that will resist accidental leaking or displacement. As seen in these figures, one of such means is the retaining lug 50 seen at the upper part of the body and adapted to lock to a flange built into the container. A flange 52 on the body 12 is adapted to extend over the opening in the container. Other means of attachment may also be employed such as a simple friction fit; or the use of a clenching or pressure ring; or heat and induction sealing and the like.

In order to function as required the device 10 of FIG. 1 is joined to a probe 54 which is constructed to extend to the bottom of a given container, the container preferably being manufactured with a sump therein. The probe 54 is usually, although not necessarily, assembled with the device 10 being attached thereto by the retainer means 56. The probe can be previously inserted in position within the container by other suitable means. In operation, the face or top of the piston cap 22 must be removed from the opening 14B in the cover by a distance sufficient to permit the required flow of liquid between the piston and the cover. Simultaneously, the flap valve defined by the outer portion of flange 14A must be completely or partially depressed so as to permit the replacement of the displaced volume within the container.

In order to minimize product contamination at the underside of the flange valve, and so as not to submit it to undue physical stress, a partial restriction is formed by the main body. This restriction comprises a fixed element that contains openings 60 in the bottom of the body. These openings are spaced around the periphery and typically may be eight in number; they are positioned to permit draining to further reduce the risk of contamination. A further use of these openings 60 is to permit the spraying of rinse water within the container, usually after the contents have been extracted. For this purpose, the openings are designed to an appropriate shape as seen, and are so positioned at the end of passageway 34 to provide rinse water to all six internal surfaces of the container.

On completion of the emptying and washing cycle, where performed, or on completion of partial emptying, followed by detachment of the extraction device, the piston returns to its original position. Empty containers can be refilled or disposed of, and partially filled containers can be reopened by repeating the original procedure.

It will be understood that refilling of containers can take place through the container-mating device 10 of the invention; or else a given unit can be removed and replaced with a new unit if required. Refilling through the unit can be inhibited by the introduction of either a ball or flap check-valve system.

It will be apparent to those skilled in the art that modifications of the embodiment of FIG. 2 can be provided. For example, the valve defined by the outer portion of flange 14A in cooperation with the interior of the body 12 can be eliminated. In place of this valve, a compressible, chemical-resistant foam gasket could be formed and inserted within the space or cavity 34 between the inner and outer walls of the body 12. Such gasket would be situated so as normally to cover the openings 60 but, when depressed, to permit access to the air and water return openings.

A further modification (not shown) of the device of FIG. 2 can be provided in order that the slots may be wiped clear of obstructions when the flange is depressed. This is useful in the cases of certain chemicals which do produce such obstructions. In such modifications the slots would be formed just below the point at which the flange 14A meets the interior of the wall 32. Peripheral extensions would be provided on the flanges 14A so that such flanges would enter the newly located slots at the time of assembly and thereby would still form a suitable seal.

Figure 3:
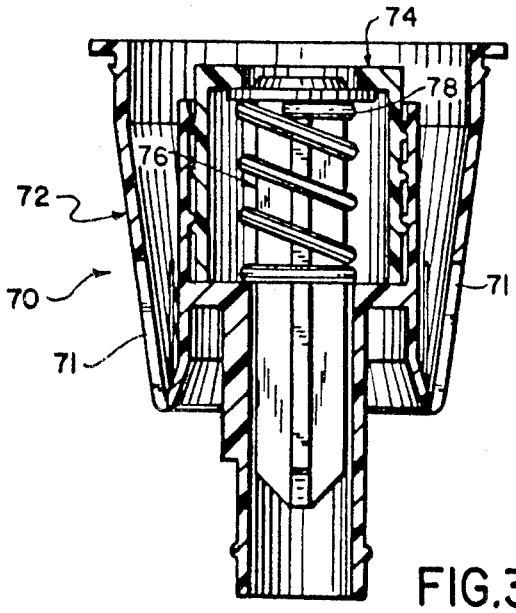
FIG. 3 is a sectional view of another embodiment of the container-mating device.

A second embodiment of the container-mating device of the present invention is depicted in FIG. 3. In this particular embodiment, like the modification of FIG. 2 already described, the valve defined by the outer portion of flange 14A has been eliminated. Furthermore, instead of the gasket referred to for selectively closing the openings 60, the bottom and lower portions of the outside wall of the body 12 are partially or completely slit vertically. The slits 71 are opened either from water or air pressure; or else they are opened by a device on the extractor. In other words, the extractor is modified to coact with the slits 71 seen in FIG. 3.

Figure 4:
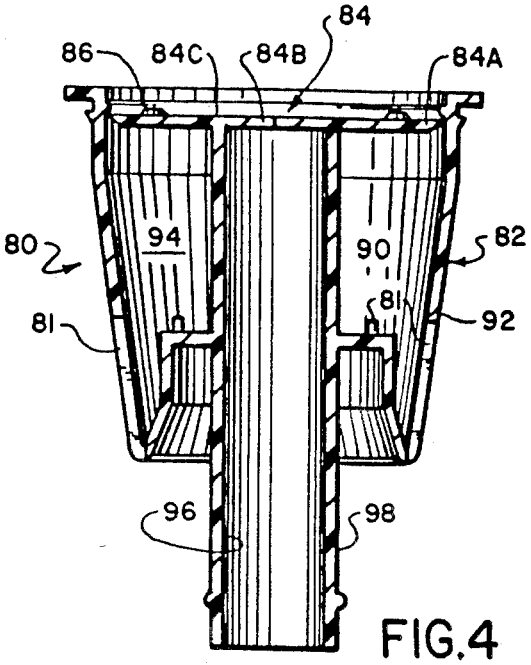
FIG. 4 is a sectional view of a third embodiment of such device.

Referring now to FIG. 4, still another embodiment of the container-mating device, designated here as 80, is depicted. It will be noted that the cover previously provided is not included; neither is a piston or spring. The cylindrical central portion seen in FIG. 2 is herewith extended and is designated 98; it defines a bore 96 similar to that in FIG. 2.

The central valve for controlling liquid chemical flow into or out of the container is provided by the inwardly directed portions 84B of flange 84 formed as part of the one piece body 82. The outwardly directed portions 84A close the space 94 defined by the inner and outer walls 90 and 92. Although inwardly directed portions 84B of flange 84 are provided with spot hinges 84C in the embodiment of FIG. 4, it will be apparent that a single portion could be provided, and be suitably hinged on either the right or left. The mating extractor device (not seen) to be utilized with the particular embodiment of FIG. 4 would be aligned to the opening through methods such as using raised sections 86.

Figure 5:
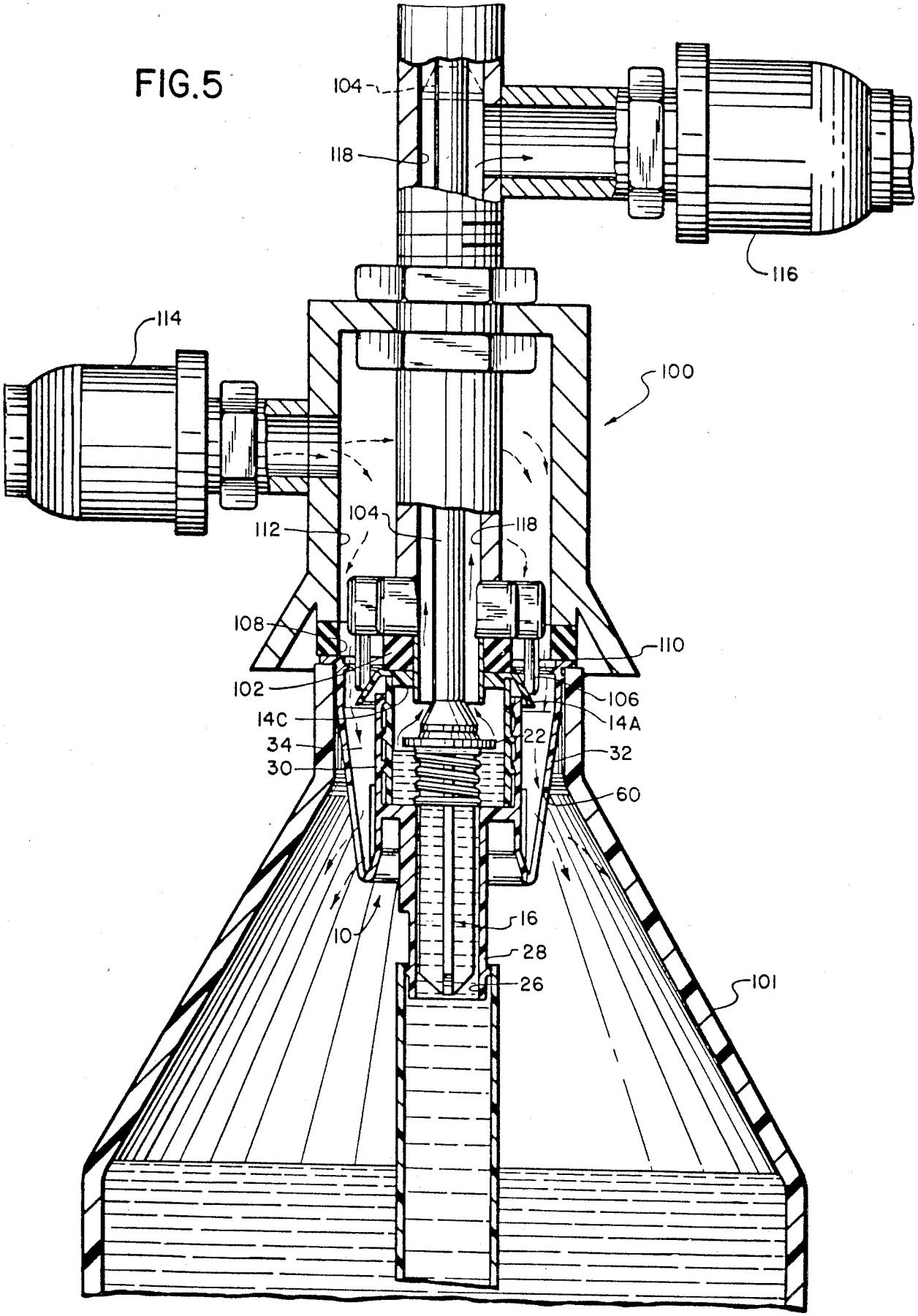
FIG. 5 is a sectional view of an extractor device which mates with the device of FIGS. 1 and 2.

The particular embodiment of the extracting device 100 seen in FIG. 5 comprises a mating arrangement adapted to function particularly with the first embodiment of the container-mating device 10, seen here and seen previously in FIGS. 1 and 2. This extracting device 100 restricts access solely to one valved section, a piston and body, air relief valve, water supply and attachment for take-off tube. The arrangement has a further refinement; namely, that it may include a stand (not shown) into which the container 101 may be placed in register with the extractor device 100, which is then brought into pressure contact with the container-mating device 10, whence it forms a seal and is operated through the various phases described.

The extractor device 100 has the necessary elements built in with which to depress the flange valves. Thus, the construction is such that the action of several depressing means can occur simultaneously with face-to-face mating of the two devices 10 and 100. Alternately, the depressing means can be independently operated.

As will be appreciated by reference to FIG. 5, a sealing ring 102, adapted to engage with the inwardly directed flange portion 14C of cover 14, insures that the two liquid flows will be isolated. When the extractor device 100 is brought down against the container-mating device 10, the arrangement is such that a plunger 104 is forced against the valve member 22. At the same time, depressing elements, in the form of spaced prongs 106, act to bend down the outwardly directed flanges 14A so that the rinse water can pass down into the passageway or space 34, thence to reach the openings 60.

Appropriate openings 108 are provided in the lower face 110 of the extractor device, and a passageway 112 leads to a hose coupling or fitting 114. The liquid chemical in the container is withdrawn by means of a suitable suction source (not shown) which is connected by way of coupling 116 to the passageway 118 which surrounds the plunger 104.

The essential advantages of the present invention will have become apparent; namely, that the essential ability is present to rinse or flush the containers before emptied containers are disconnected for disposal. Moreover, the withdrawal of the dangerous chemical will be accomplished without interfering with the rinse or flush scheme; also, the bending of the flange portions 14A will enable replacement of the volume being withdrawn.

A desirable feature for the user when making up a tank mix is to know the volume of water used for rinsing. Accordingly, a cistern (not shown) of sufficient capacity would be associated with the extractor device and would be utilized in the function of rinsing the container. At the conclusion of the extracting cycle, the operator would actuate a cistern mechanism which permits a given volume of water to flow and to be sprayed into the container. As the water falls to the bottom of the container, it can be sucked out through the bore 26. The system would be arranged to automatically shut off and refill. At the conclusion of the rinsing cycle, the operator would move a lever (not shown) which, in turn, causes the plunger 104 to return to its upper or closed position before the extractor is lifted from the container.

Although it has been indicated that the container would preferably be mounted on a stand, it is not necessary to do so and the unit could be attached to a container by the use of existing internal or external screw threads that are available; by locking to a Reike flex-spout flange, or by a locking arrangement within the unit.

In accordance with the present continuation-in-part application, a number of improvements are herewith described.

As a result of the practical experience gained with container-mating closure devices already disclosed, improvements have been developed which relate chiefly to the probe means, which is reconstructed to form a combined probe-closure unit. Certain drop tests reveal that a serious problem occurs if the container is dropped sufficiently hard on either its bottom or top - circumstances which could arise with any container. The effect of such drops is either to cause the probe to dislodge or break, or to cause the probe to go through the bottom or top of the container. In the best cases, i.e.

where the probe is merely dislodged, the defect is such that the probe cannot perform its desired function of voiding the container.

Accordingly, another primary object is to provide a solution to the problem just described.

Instead of the probe being fixed in place, the improved feature resides in having the probe in a retracted state until the time of use. At that time, the probe is caused to be lowered as the extraction device is joined or mated with the closure device.

Figure 6:
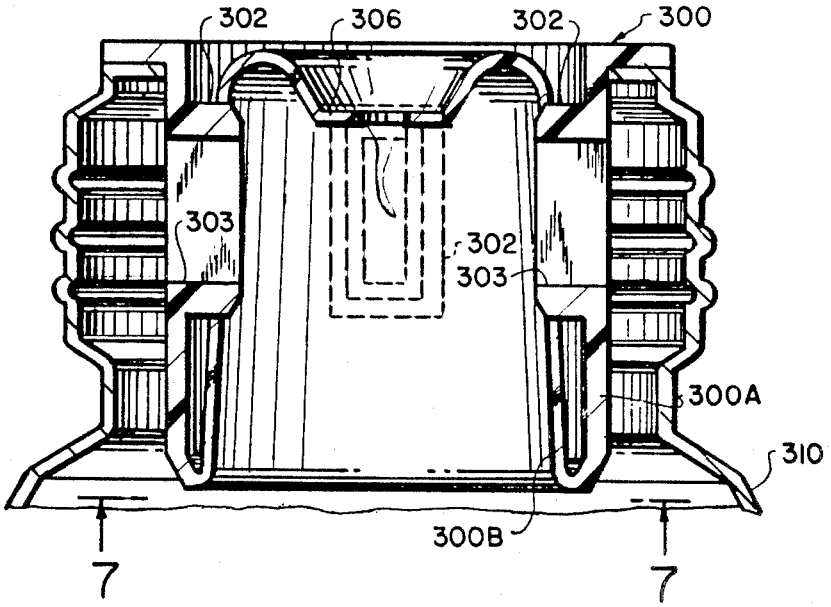
FIG. 6 is a vertical sectional view of the retractable probe means in accordance with another embodiment of the invention.
Figure 7:
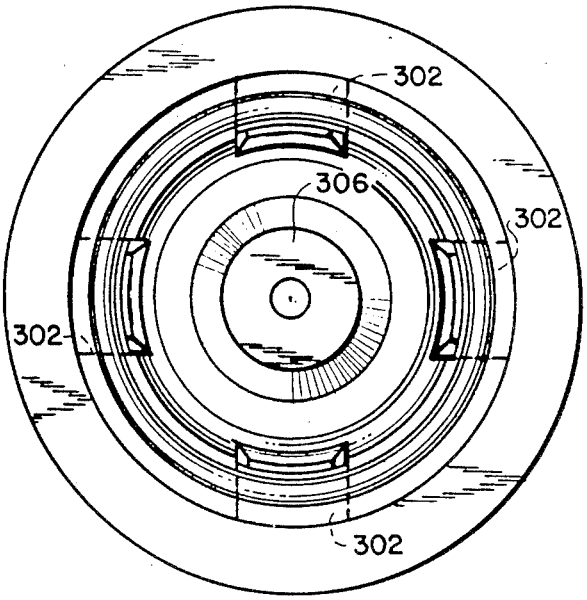
FIG. 7 is a section taken on the line 7—7 of FIG. 6.
Figure 9:
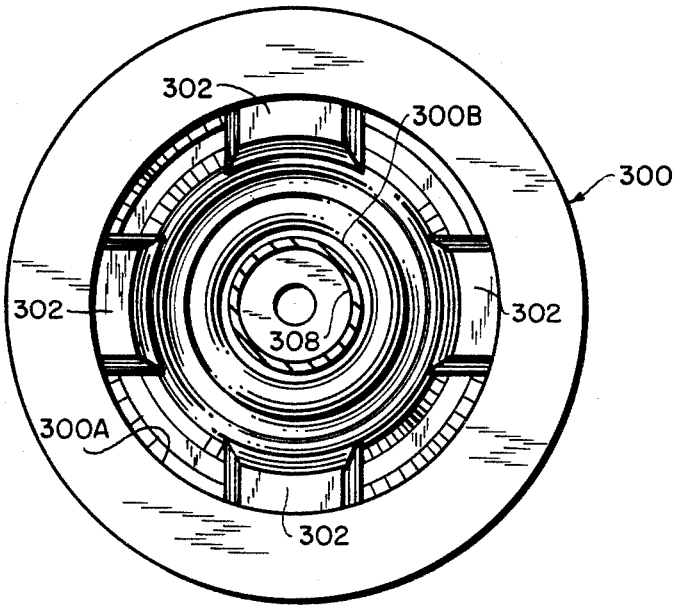
FIG. 9 is a section taken on the line 9—9 of FIG. 8.

Referring now to FIGS. 6–11, there is seen a probe means 300 which has been formed of one piece of plastic and employs no springs. As a consequence, its assembly is greatly simplified. This improved probe means 300 is preferably injection molded in one piece and is folded back into itself while still warm, for ease of assembly; it is provided with an upper, relatively thick portion 300A, and a lower, relatively thinner portion 300B which, as will be seen in FIG. 6, is folded back. The upper portion 300A is provided with lugs 302 around which the folded up portion 300B can be retained by reason of the suitably spaced openings or slots 304 with which it is provided.

Figure 8:
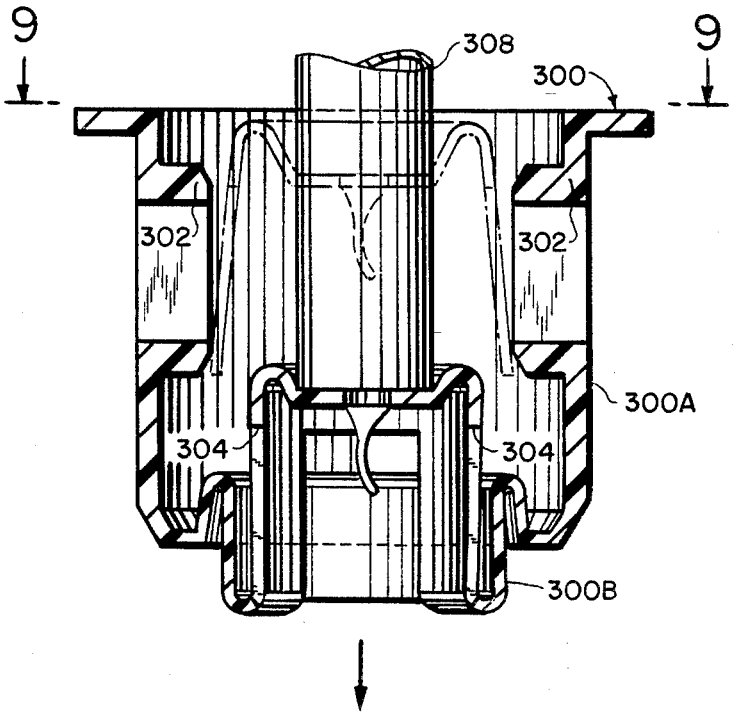
FIG. 8 is a vertical sectional view, similar to FIG. 6, but showing the probe means in the process of being deployed from its retracted state.

Also provided in this probe means 300 is an arrangement for liquid extraction, such arrangement including a membrane 306 at the bottom of the probe means and an extraction device including the cylindrical member 308. Thus, it will be appreciated from FIG. 8 that when extraction is to be accomplished, this member 308 is pushed inwardly of the container 310 (FIG. 6). Consequently, the folded up portion 300B is peeled away from the lugs 302 and, as seen by the dotted lines in FIG. 8, is extended down into the container 300.

The extraction hole for enabling extraction of the dangerous chemical is created by reason of the member 308 functioning simply to tear away the membrane 306; or, the bottom of the probe means 300 may include a plunger mechanism for sealing against liquid leaks. An alternative means of sealing against liquid flow is a valve in the bottom of the probe means 300 which would be opened through contact with the container bottom.

Figure 10:
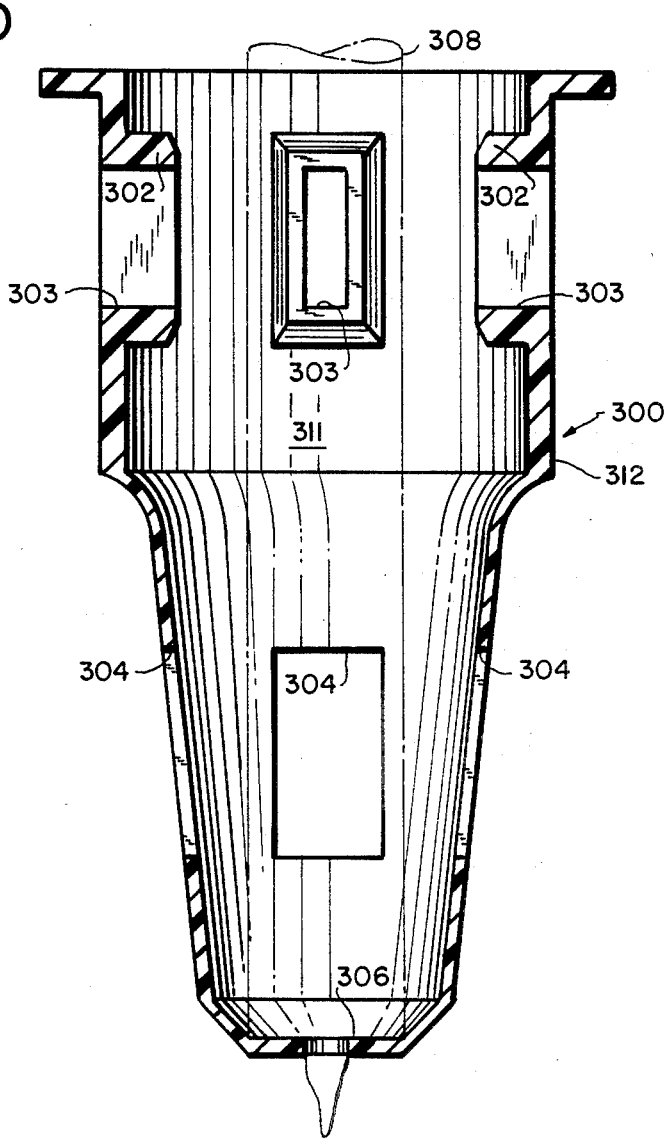
FIG. 10 is a vertical sectional view of the probe means when fully extended.
Figure 11:
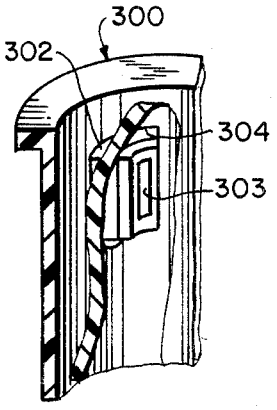
FIG. 11 is a fragmentary view of the portion of the probe means which its over a lug provided on such probe means.

It will be apparent by reference to FIG. 6 that the arrangement of the retractable probe means 300 permits the critical two-way flow; that is to say, when the probe means is deployed as seen in FIG. 10, the required withdrawal of chemical contents can be effectuated through the extracting member 308, while suitable ambient pressure is supplied by the passageway 311 defined between the extracting member 308 and the wall 312 of the probe means 300. Likewise, when it is desired to spray the interior of container 310, water or other liquid is transmitted through the openings 303 and the spray water is removed through the extracting member 308.

Although one particular form or embodiment of a retractable probe means has been illustrated in accordance with this application, it will be evident that alternate embodiments can be provided. For example, the probe means 300 can be fashioned by the use of an alternating slot and plug arrangement whereby a series of plugs on one side of a hinged webbing is sealed into a corresponding series of slots on the other side when the probe means is retracted as pressure is brought to bear, but unsealed when the extracting member is projected into the container.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

I claim:

1. A container-mating closure unit for attachment to an extraction device to provide selective access to the interior of a container, comprising:

a housing adapted to be attached to a container in a fluid-tight manner, said housing defining an inner chamber and an outer chamber that is separate from and surrounds said inner chamber, said outer chamber being in fluid communication with the interior of the container;

a downtube providing fluid communication between said inner chamber and the container;

an outlet valve that is automatically opened when an extraction device is attached to the container to provide the extraction device with access to said inner chamber; and a lid that closes the top of said housing, said lid comprising a flange that forms a flap valve which normally closes off said outer chamber from the exterior of the container and that is deformed inwardly into said outer chamber when the extraction device is attached to the container to provide the extraction device with access to said outer chamber.

2. A closure unit according to claim 1, wherein said outlet valve comprises a valve disk which is pressed onto a valve seat by a spring, a portion of said lid which covers said inner chamber having a central opening which forms said valve seat, said outlet valve operating such that the extraction device, on being mounted on the closure unit, displaces the valve disk away from said seat downwards against the force of the spring to thereby open the valve.

3. A closure unit according to claim 2, wherein said housing is formed by an outer hollow body having a circular shape with an essentially B-shaped cross section open at the top, and having an inner wall that is substantially cylindrical and provided with annular rings; and an inner hollow body of substantially cylindrical form and having projecting annular rings, said two hollow bodies being fitted together to form said housing and being held in place by said annular rings.

4. A closure unit according to claim 3, wherein said outer hollow body has an inwardly projecting annular shoulder which forms a connection for said downtube.

5. A closure unit according to claim 4, wherein said inwardly projecting annular shoulder also provides a support for said valve spring.

6. A closure unit according to claim 5, wherein said lid is an integral part of said inner hollow body.

7. A closure unit according to claim 1, wherein a portion of the lid which covers the inner chamber has a central elastically flexible area with a slit, the edges of which are positioned tightly against one another, said slit being opened by the extraction device which it is mounted on the closure unit, and closing again when the device is removed.

8. A closure unit according to claim 1, wherein said lid is formed in one piece from elastically flexible material.

9. A closure unit according to claim 1, wherein said lid and a cylindrical wall defining the inner chamber are formed in one piece from a plastic material.

10. A closure unit according to claim 9, wherein said downtube is also formed integrally with said lid and cylindrical wall.

* * * * *